US005215372A

United States Patent [19]

Milstead

[11] Patent Number: 5,215,372

[45] Date of Patent: Jun. 1, 1993

[54] AGGREGATE STORAGE APPARATUS FOR USE IN PRODUCING ASPHALTIC MIX

[75] Inventor: John Milstead, Chattanooga, Tenn.

[73] Assignee: Astec Industries, Inc., Chattanooga, Tenn.

[21] Appl. No.: 657,539

[22] Filed: Feb. 19, 1991

[51] Int. Cl.[5] ..... B28C 7/04

[52] U.S. Cl. ..... 366/18; 209/373; 366/16; 366/22

[58] Field of Search ..... 222/129, 504, 556, 564; 209/240, 255, 373; 366/16-19, 21-23, 189, 192, 141, 152, 181, 182, 193, 101; 220/501

[56] References Cited

U.S. PATENT DOCUMENTS

| | | | |
|---|---|---|---|
| 713,436 | 11/1902 | Hodge . | |
| 725,641 | 4/1903 | Ash | 209/240 X |
| 808,599 | 12/1905 | Crichfield | 366/18 |
| 1,717,902 | 7/1929 | Wiencke . | |
| 1,724,403 | 8/1929 | Hutchinson | 222/129 X |
| 2,603,342 | 7/1952 | Martinson | 222/504 X |
| 2,638,254 | 5/1953 | Heltzel | 222/556 X |
| 2,661,876 | 12/1953 | Kindseth | 222/504 |
| 2,663,466 | 12/1953 | Heltzel | 222/505 |
| 2,741,401 | 4/1956 | Kehres et al. . | |
| 2,873,955 | 2/1959 | Sauer | 366/19 |
| 2,893,602 | 7/1959 | Barber et al. | 366/18 X |
| 2,970,532 | 2/1961 | Skelton . | |
| 3,081,009 | 3/1963 | Cooper | 222/564 X |
| 3,091,369 | 5/1963 | Sackett, Sr. | 222/504 X |
| 3,170,677 | 2/1965 | Phister, Jr. et al. . | |
| 3,297,159 | 1/1967 | Heise . | |
| 3,351,248 | 11/1967 | Baehr | 222/564 X |
| 3,661,365 | 5/1972 | Cloud, Jr. | 366/22 X |
| 3,746,313 | 7/1973 | Weeks et al. . | |
| 3,915,343 | 10/1975 | Barcock | 222/564 X |
| 4,022,439 | 5/1977 | Groth . | |
| 4,579,458 | 4/1986 | Ohlson | 366/17 X |

FOREIGN PATENT DOCUMENTS

| | | | |
|---|---|---|---|
| 435066 | 2/1922 | Fed. Rep. of Germany | 366/19 |
| 1329422 | 4/1963 | France | 222/504 |
| 161741 | 4/1921 | United Kingdom | 366/19 |
| 193442 | 2/1923 | United Kingdom | 366/19 |
| 358218 | 10/1931 | United Kingdom | 222/556 |
| 782508 | 9/1957 | United Kingdom | 366/182 |
| 926633 | 5/1963 | United Kingdom | 222/504 |
| 1517126 | 7/1978 | United Kingdom | 366/16 |

*Primary Examiner*—Harvey C. Hornsby
*Assistant Examiner*—Charles Cooley
*Attorney, Agent, or Firm*—Bell, Seltzer, Park & Gibson

[57] ABSTRACT

An asphaltic mix batch apparatus which comprises a tower which mounts a number of aggregate storage bins, a weigh hopper underlying the storage bins, and a pugmill underlying the weigh hopper. Also, a screen assembly is positioned above the bins for segregating the aggregate by size, and such that the initial bin receives the more fine aggregate and the subsequent bins receive the more coarse aggregate. The initial bin has a relatively wide open top, and it receives a relatively broad gradation of the aggregate from its front to its back, with the front being disproportionately fine and the back being disproportionately coarse. A divider plate is positioned in the initial bin to prevent the gradation from interfering with the free discharge of the aggregate when the associated discharge port is opened, and to thereby provide a more uniform gradation being withdrawn through the discharge port.

9 Claims, 2 Drawing Sheets

AGGREGATE STORAGE APPARATUS FOR USE IN PRODUCING ASPHALTIC MIX

BACKGROUND OF THE INVENTION

The present invention relates to a storage apparatus adapted for separately storing several graded sizes of a particulate aggregate, and which is useful in the production of an asphaltic mix.

Conventional batch type plants for producing asphaltic mix typically comprise a drum dryer for heating and drying the stone aggregate, and a vertical bucket elevator for conveying the heated and dried aggregate from the dryer to the top of a tower. The tower includes an enclosed vibrating screen assembly at the top, for receiving and segregating the aggregate by size. The segregated aggregate then drops through individual chutes to a bin section which underlies the screen assembly, and which comprises a plurality of separate bins aligned in a transverse direction, and so that each bin receives an aggregate of a predetermined average size from the screen assembly. A weigh hopper is positioned below the bins, which permits the aggregate from one or more bins to be weighed out to provide a desired mixture, as required for example for a roadway base coat or a finish coat. A mixing pugmill is positioned below the weigh hopper for mixing the weighed quantity of aggregate with hot liquid asphalt, and the bottom of the pugmill includes a gate opening, such that the contents may be dropped into an underlying truck.

The initial bin in the transverse line of bins, and which is commonly referred to as the "fines" bin, receives the relatively fine aggregate, and the aggregate becomes progressively more coarse as it is delivered into the subsequent bins at the downstream end of the screen assembly. Also, the initial fines bin typically has an open top of substantially greater dimension than that of the remaining bins, and thus the initial fines bin receives a much broader range of aggregate size than does the other bins. A longstanding problem is the fact that the finer portion of this range of aggregate size which is destined for the initial fines bin tends to find its way quickly through the associated screen while the more coarse portion takes a longer time. This results in a gradation of the aggregate within the initial fines bin, with a more fine portion of the aggregate being received in the front end of the bin and a more coarse portion of the aggregate being received in the rear end of the bin. This gradation in turn creates a problem in withdrawing the aggregate from the discharge port at the bottom of the bin, in that the coarse aggregate tends to crowd out the fine aggregate and prevents it from flowing out uniformly. Thus, when the discharge port is opened, the discharge includes surges of coarse and fine aggregate, and the discharge is not uniform. As a result, it is not possible to accurately control the size of the aggregate in the asphaltic mix being produced.

It is accordingly an object of the present invention to provide an apparatus for producing asphaltic mix and which avoids or at least significantly alleviates the above noted problem associated with conventional plants.

It is a more particular object of the present invention to provide an apparatus for producing asphaltic mix which achieves a substantially uniform discharge of both the relatively fine and the relatively coarse aggregate in the initial fines bin upon opening of the discharge port thereof, and so that the size of the aggregate in the resulting asphaltic mix can be accurately controlled.

SUMMARY OF THE PRESENT INVENTION

The above and other objects and advantages of the present invention are achieved in the embodiment illustrated herein by the provision of an aggregate storage apparatus which comprises a plurality of separate storage bins positioned in a side by side arrangement and so as to define a line of the bins extending along a predetermined transverse direction, with each of the bins including an open top and a discharge port at its bottom, and with the open tops being aligned adjacent each other along the transverse direction. An aggregate screening assembly is positioned above the bins for sizing and delivering a particulate aggregate into the bins and such that the aggregate becomes progressively more course as it is delivered along the transverse direction from an initial bin at one end of the line to a final bin at the opposite end of the line. A separately operable discharge gate is mounted at the discharge port of each of the bins. Also, a divider plate is positioned in the initial bin and which extends across the initial bin in a direction generally perpendicular to the transverse direction. The plate also extends from a location immediately adjacent the discharge port upwardly a substantial portion of the height of the initial bin. Surprisingly, it has been found that the divider plate serves to prevent the gradation of the particulate aggregate within the initial bin from interfering with the free discharge thereof when the associated discharge port is opened.

The apparatus of the present invention also preferably includes an upright tower which mounts the storage bins at the upper portion thereof. Also, a drum dryer is provided for initially heating and drying the aggregate, and an elevator is provided for receiving the heated aggregate from the drum dryer and conveying the same upwardly and into the aggregate screening assembly. Further, the present invention includes a weigh hopper which is mounted in the tower below the storage bins for weighing out a selected amount of the aggregate from each of the bins, and a mixing apparatus which is mounted in the tower below the weigh hopper for selectively receiving aggregate from the weigh hopper and mixing the same with a predetermined amount of liquid asphalt, and for delivering the resulting asphaltic mix into an underlying truck or the like.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
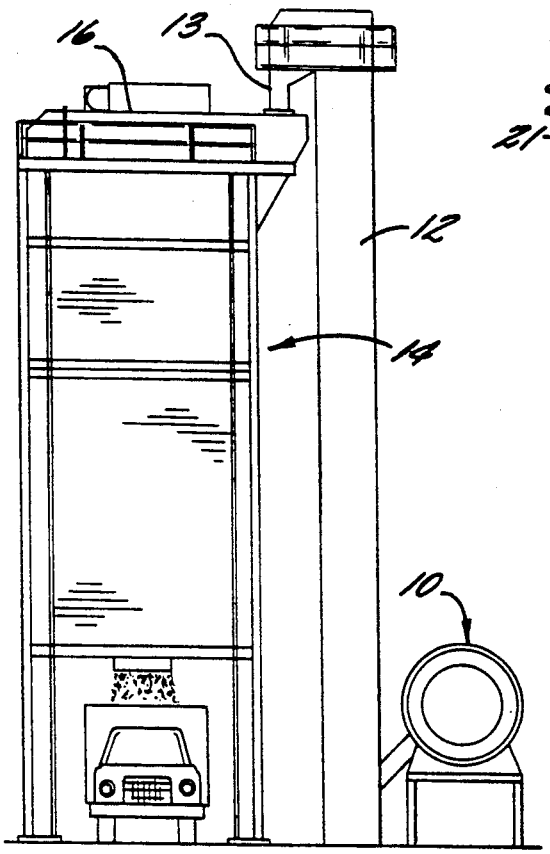
FIG. 1 is a side elevation view of an asphaltic mix batching apparatus which embodies the features of the present invention.

Referring more particularly to the drawings, FIG. 1 illustrates an asphaltic mix batching apparatus in accordance with the present invention, and which comprises a drum dryer 10 of conventional design for heating and drying stone aggregate. The dryer 10 delivers the heated and dried aggregate to a bucket type enclosed elevator 12, which conveys the aggregate upwardly to a discharge outlet 13 located above a tower 14.

Figure 3:
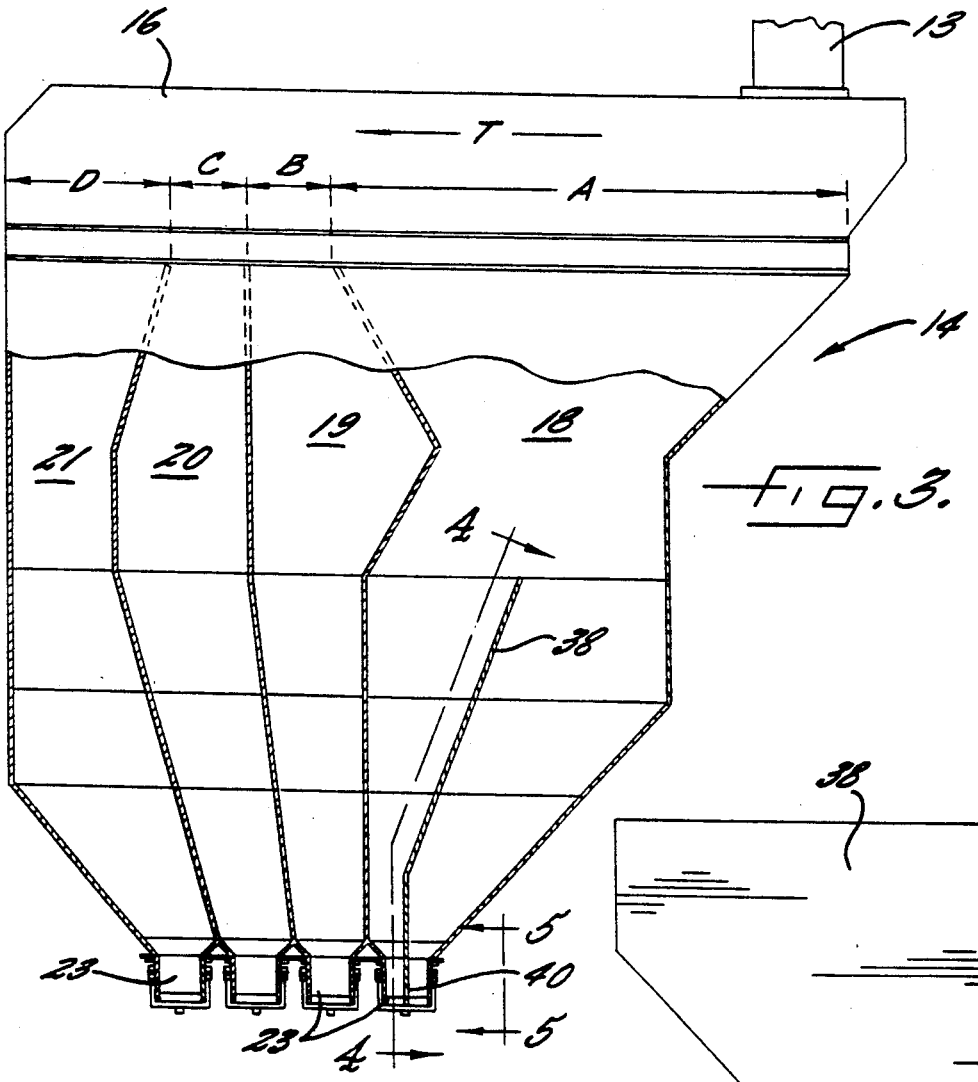
FIG. 3 is a partially sectioned side elevation view of the storage bins of the present invention.
Figure 4:
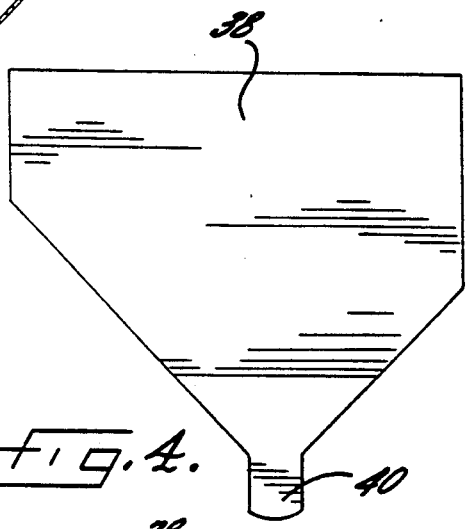
FIG. 4 is a view of the divider plate positioned in the initial bin, and taken substantially along the line 4—4 of FIG. 3.

An aggregate screening assembly 16 is mounted at the top of the tower for receiving the aggregate, and the screening assembly 16 delivers the aggregate into a plurality of separate storage bins which are mounted in the upper portion of the tower and positioned in a side by side arrangement, so as to define a line of the bins extending along a predetermined transverse direction T as seen in FIG. 3. Four bins 18, 19, 20, 21 are employed in the illustrated embodiment, and each of the bins includes an open top and a discharge port 23 at its bottom. The open tops are aligned adjacent each other along the transverse direction T.

The aggregate screening assembly delivers the aggregate into the bins 18–21 such that the aggregate becomes progressively more coarse as it is delivered along the transverse direction from the initial bin 18 to the final bin 21. A screening assembly of the described type is well-known in the art, and is described, for example, in U.S. Pat. No. 2,893,602, the disclosure of which is incorporated herein by reference.

Figure 2:
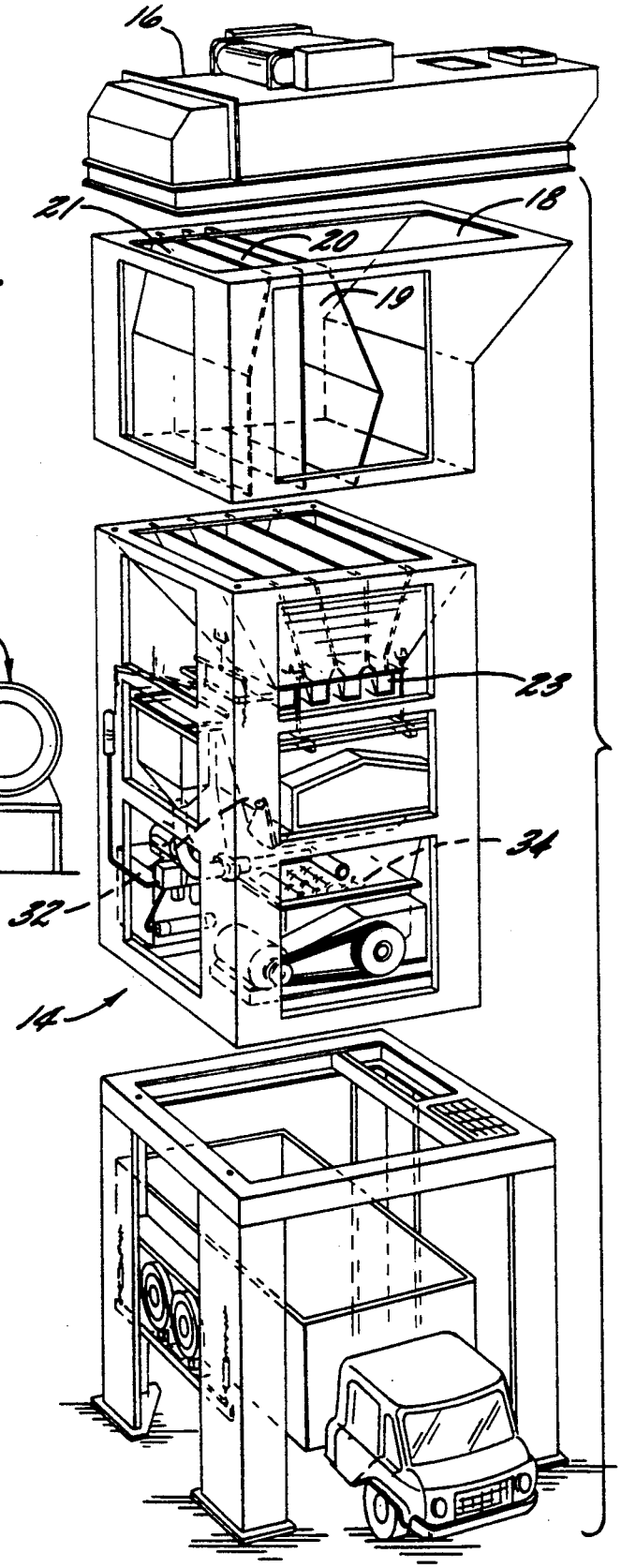
FIG. 2 is an exploded perspective view of the storage tower of the present invention.

As best seen in FIGS. 2 and 3, the open top of the initial bin 18 has a dimension A along the transverse direction, which is substantially greater than the corresponding dimension B, C, D of any of the three remaining bins 19–21 In the illustrated embodiment, the open top of the initial bin 18 has a transverse dimension A (note FIG. 3) which is at least equal to, and preferably is more than, the sum of the corresponding dimensions B, C, D of all of the remaining bins 19–21.

Figure 5:
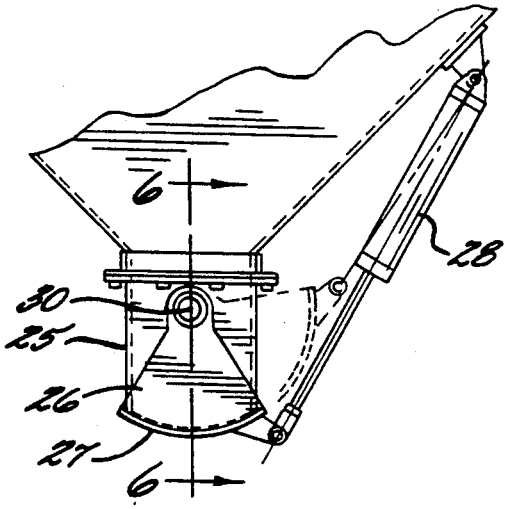
FIG. 5 is an enlarged fragmentary and partly sectioned view of the discharge port of the initial bin, with the discharge gate removed for clarity of illustration.
Figure 6:
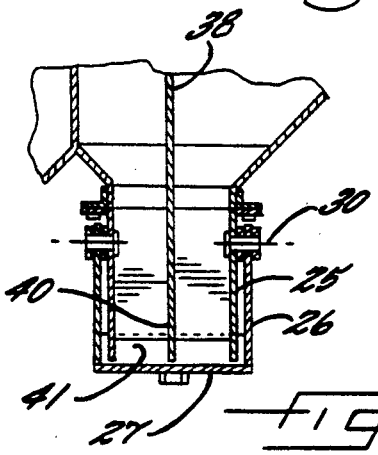
FIG. 6 is a fragmentary side elevation view taken at right angles to FIGS. 3 and 4, and showing the discharge port and gate at the bottom of the initial storage bin.

As best seen in FIG. 3, the cross sectional configurations of the bins 18–21 vary in a manner known in the art, to provide the desired capacities. Also, the lower portions of the bins are tapered inwardly so that each bin terminates in a rectangular, substantially square, discharge port 23. Each port 23 includes a chute 25 of substantially square cross section and which extends downwardly a short distance as best seen in FIGS. 5 and 6.

A separately operable discharge gate 26 is mounted to the discharge chute 25 of each of the bins, and each gate comprises a plate 27 which is mounted for pivotal movement between a closed position covering the bottom of the discharge chute and an open position (shown in broken lines in FIG. 5) withdrawn from the bottom of the discharge chute. Also, each plate 27 is moved between the open and closed positions by means of a hydraulic cylinder 28, and each plate is mounted for pivotal movement about an axis 30 which extends through the chute in a horizontal direction which is generally parallel to the transverse direction T. The lower end of each discharge chute is arcuately curved in cross section as seen in FIG. 5, with the curvature being defined by an arc of a circle centered at the pivotal axis 30. Each plate 27 is correspondingly curved.

A weigh hopper 32 of conventional design is mounted to the tower below the storage bins for weighing out a selected amount of the aggregate from each of the bins, and a pugmill 34 of conventional design is mounted to the tower below the weigh hopper for selectively receiving aggregate from the weigh hopper and mixing the same with a predetermined amount of hot liquid asphalt. The pugmill 34 includes a bottom gate (not shown) for delivering the resulting asphaltic mix into an underlying truck.

In accordance with the present invention, a solid divider plate 38 is positioned in the initial bin 18 and extends fully across the initial bin in a direction generally perpendicular to the transverse direction T. Also, the divider plate 38 extends from a location immediately adjacent the discharge port 23, upwardly a substantial portion of the height of the initial bin 18. More particularly, the divider plate 38 includes a lower end portion 40 which extends along substantially the full height of the associated chute 25 and across substantially the full width thereof. Also, the pivotal axis 30 of the associated gate extends perpendicularly through the lower end portion 40 of the divider plate. In the illustrated embodiment, the divider plate 38 extends upwardly for about one half the height of the initial bin 18.

As indicated above, the right side of the initial bin 18 as seen in FIG. 3 will receive the more fine portion of the aggregate received in the initial bin from the screening assembly 16, and the left side will receive the more coarse aggregate portion. The divider plate 38 has been found to prevent the more coarse aggregate from crowding out the more fine aggregate as it passes downwardly through the discharge chute 25 when the gate 26 is opened, and as a result, the more coarse aggregate and the more fine aggregate flow downwardly through the chute in a relatively uniform and predictable manner when the gate is opened. This in turn permits the size of the aggregate in the resulting asphaltic mixture to be accurately controlled.

As noted above, the discharge gate 26 of the initial ben 18 swings about an axis 30 which extends perpendicularly through the lower end portion 40 of the divider plate 38. Thus in the event the gate of the initial bin were to partially open, the portions of the discharge chute on the opposite sides of the divider plate would be equally opened, and thus the aggregate falling through the opened portions would represent the entire gradation of the aggregate. A uniform discharge is thereby assured.

In the drawings and specification, there has been set forth a preferred embodiment of the invention, and although specific terms are employed, they are used in a generic and descriptive sense only and not for purposes of limitation. Also, while the present invention has been illustrated in association with an asphalt producing plant, it will be understood that the novel features of the invention are applicable to aggregate storage bins of other types and sizes and which receive graded aggregate from a common screening assembly.

That which is claimed is:

1. A storage apparatus adapted for separately storing several graded sizes of particulate aggregate and comprising a plurality of separate storage bins positioned in an aligned side by side arrangement and so as to define a line of said bins extending along a predetermined horizontal transverse direction, with each of said bins including an open top and a discharge port at its bottom, and with said open tops being aligned adjacent each other along said transverse direction, aggregate screening means positioned above said bins for sizing and delivering a particulate aggregate into said bins such that the aggregate becomes progressively more coarse as it is delivered along said transverse direction from an initial bin at one end of said line to a final bin at the opposite end of said line, a separately operable discharge gate mounted at said discharge port of each of said bins, each of said discharge ports comprising a downwardly directed discharge chute, and each of said gates comprising a plate mounted for pivotal movement between a closed position covering the bottom of the associated discharge chute and an open position withdrawn from the bottom of the associated discharge chute, and a divider plate positioned in said initial bin and extending across said initial bin in a direction generally perpendicular to said transverse direction and extending from a location immediately adjacent said discharge port upwardly at least a substantial portion of the height of said initial bin, with said divider plate defining a single, relatively thin line when viewed in vertical cross section taken along said transverse direction, and wherein said plate of said discharge gate associated with said initial bin is mounted for pivotal movement about an axis extending generally perpendicular to said divider plate, and such that said divider plate serves to prevent a gradation of the particulate aggregate within said initial bin from interfering with the free discharge thereof when the associated discharge port is opened.

2. The storage apparatus as defined in claim 1 wherein said open top of said initial bin has a dimension measured along said transverse direction which is substantially greater than the corresponding dimension of any of the remaining bins.

3. The storage apparatus as defined in claim 2 wherein said open top of said initial bin has a dimension measured along said transverse direction which is at least equal to the sum of the corresponding dimensions of all of the remaining bins.

4. The storage apparatus as defined in claim 1 wherein said divider plate includes a lower end portion which extends along substantially the full height of the associated chute and across substantially the full width thereof, and wherein said pivotal axis of the associated gate extends perpendicularly through said lower end portion.

5. The storage apparatus as defined in claim 1 wherein the portion of said divider plate which is adjacent the discharge port of said initial bin defines an essentially vertical plane which divides said discharge port into two substantially equal portions on respective opposite sides of said plane, and wherein said discharge gate associated with said initial bin comprises a plate which is mounted for movement between closed and open positions along a direction which is parallel to said plane, such that said two portions of the discharge port are equally opened when said plate of the associated discharge gate is moved away from said closed position.

6. An asphaltic mix batching apparatus comprising an upright tower, a plurality of separate bins mounted in the upper portion of said tower and positioned in an aligned side by side arrangement and so as to define a line of said bins extending along a predetermined horizontal transverse direction, with each of said bins including an open top and a discharge port at its bottom, and with said open tops being aligned adjacent each other along said transverse direction, aggregate screening means mounted to said tower above said bins for sizing and delivering a particulate aggregate into said bins such that the aggregate become progressively more coarse as it is delivered along said transverse direction from an initial bin at one end of said line to a final bin at the opposite end of said line, a separately operable discharge gate mounted at said discharge port of each of said bins, and wherein said discharge port of said initial bin comprises a downwardly directed discharge chute, and the associated discharge gate comprises a plate mounted for pivotal movement about an axis which extends generally perpendicular to said divider plate, a divider plate positioned in said initial bin and extending across said initial bin in a direction generally perpendicular to said transverse direction and extending from a location immediately adjacent said discharge port upwardly at least a substantial portion of the height of said initial bin, with said divider plate defining a single, relatively thin line when viewed in vertical cross section taken along said transverse direction, elevator means for conveying a particulate aggregate upwardly and into said aggregate screening means, weight hopper means mounted in said tower below said storage bins for weighing out a selected amount of aggregate from each of said bins, and mixing means mounted in said tower below said weigh hopper means for selectively receiving aggregate from said weigh hopper means and mixing the same with a predetermined amount of liquid asphalt, and for delivering the resulting asphaltic mix into an underlying receiver.

7. The batching apparatus as defined in claim 6 further comprising drum dryer means for heating the aggregate and delivering the heated aggregate to said elevator means.

8. The batching apparatus as defined in claim 6 wherein said divider plate includes a lower end portion which extends substantially the full height of said discharge chute, and wherein said pivotal axis of said plate of said discharge gate associated with said initial bin extends perpendicularly through said lower end portion.

9. A storage apparatus adapted for separately storing several graded sizes of particulate aggregate and comprising a plurality of separate storage bins positioned in an aligned side by side arrangement and so as to define a line of said bins extending along a predetermined horizontal transverse direction, with each of said bins including an open top and a discharge port at its bottom, and with said open tops being aligned adjacent each other along said transverse direction, aggregate screening means positioned above said bins for sizing and delivering a particulate aggregate into said bins such that the aggregate becomes progressively more coarse as it is delivered along said transverse direction from an initial bin at one end of said line to a final bin at the opposite end of said line, a separately operable discharge gate mounted at said discharge port of each of said bins, and a divider plate positioned in said initial bin and extending across said initial bin in a direction generally perpendicular to said transverse direction and extending from a location immediately adjacent said discharge port upwardly at least a substantial portion of the height of said initial bin, with said divider plate defining a single, relatively thin line when viewed in vertical cross section taken along said transverse direction, and wherein the portion of said divider plate which is adjacent the discharge port of said initial bin defines an essentially vertical plane which divides said discharge port into two substantially equal portions on respective opposite sides of said plane, and wherein said discharge gate associated with said initial bin comprises a plate which is mounted for movement between closed and open positions along a direction which is parallel to said plane, such that said two portions of the discharge port are equally opened when said plate of the associated discharge gate is moved away from said closed position, and such that said divider plate serves to prevent a gradation of the particulate aggregate within said initial bin from interfering with the free discharge thereof when the associated discharge port is opened.

* * * * *